US005722693A

United States Patent [19]

Wicker

[11] Patent Number: 5,722,693

[45] Date of Patent: Mar. 3, 1998

[54] EMBOSSED DOCUMENT PROTECTION METHODS AND PRODUCTS

[76] Inventor: Kenneth M. Wicker, 7493 Wetmore Rd., Wayland, N.Y. 14572

[21] Appl. No.: 725,407

[22] Filed: Oct. 3, 1996

[51] Int. Cl.[6] ..... B42D 15/00

[52] U.S. Cl. ..... 283/67; 285/91; 285/93

[58] Field of Search ..... 283/93, 91, 902, 283/85, 67, 901; 359/566, 568, 569, 576, 572

[56] References Cited

U.S. PATENT DOCUMENTS

| | | | |
|---|---|---|---|
| 1,354,471 | 10/1920 | Doner | 359/567 |
| 3,109,239 | 11/1963 | Wicker . | |
| 3,675,948 | 7/1972 | Wicker . | |
| 4,033,059 | 7/1977 | Hutton et al. | 283/902 |
| 4,124,947 | 11/1978 | Kuhl et al. | 283/902 |
| 4,143,967 | 3/1979 | Wicker . | |
| 4,227,720 | 10/1980 | Mowry, Jr. et al. . | |
| 4,310,180 | 1/1982 | Mowry . | |
| 4,588,212 | 5/1986 | Castagnoli | 283/91 |
| 4,632,430 | 12/1986 | Wicker . | |
| 4,684,593 | 8/1987 | Wicker . | |
| 4,715,623 | 12/1987 | Roule et al. | 283/91 |
| 4,780,397 | 10/1988 | Tsuchiya | 283/902 |
| 4,915,463 | 4/1990 | Barbee, Jr. | 359/568 |
| 5,018,767 | 5/1991 | Wicker . | |
| 5,149,140 | 9/1992 | Mowry, Jr. . | |
| 5,193,853 | 3/1993 | Wicker . | |
| 5,433,807 | 7/1995 | Hechenkamp et al. | 283/91 |
| 5,468,581 | 11/1995 | Coe . | |
| 5,487,567 | 1/1996 | Volpe . | |

FOREIGN PATENT DOCUMENTS

| | | |
|---|---|---|
| 0 490 457 B1 | 12/1991 | European Pat. Off. . |
| WO90/08046 | 9/1990 | WIPO . |

OTHER PUBLICATIONS

Webster's II New Riverside Dictionary—definition of "print", Dec. 1988.

*Primary Examiner*—Willmon Fridie, Jr.

*Attorney, Agent, or Firm*—Jaeckle Fleischmann & Mugel, LLP

[57] ABSTRACT

A method and product for making counterfeit resistant security document. The document has a first set of printed lines which form a latent image and a second set of printed lines at an angle relative to the first set which forms a background image. One of the sets of lines is embossed so as to render the latent image visible only when viewed from pre-determined non-perpendicular angles relative to said document.

18 Claims, 4 Drawing Sheets

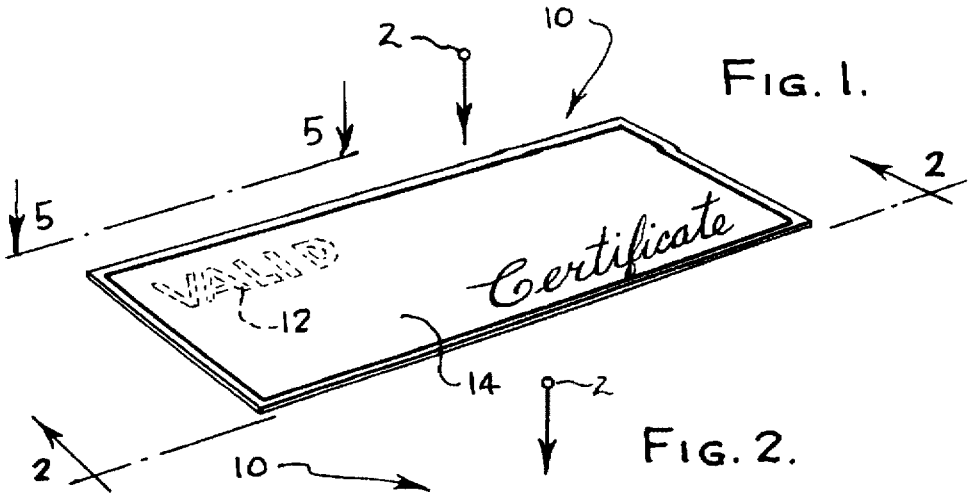
FIG. 1.
FIG. 2.
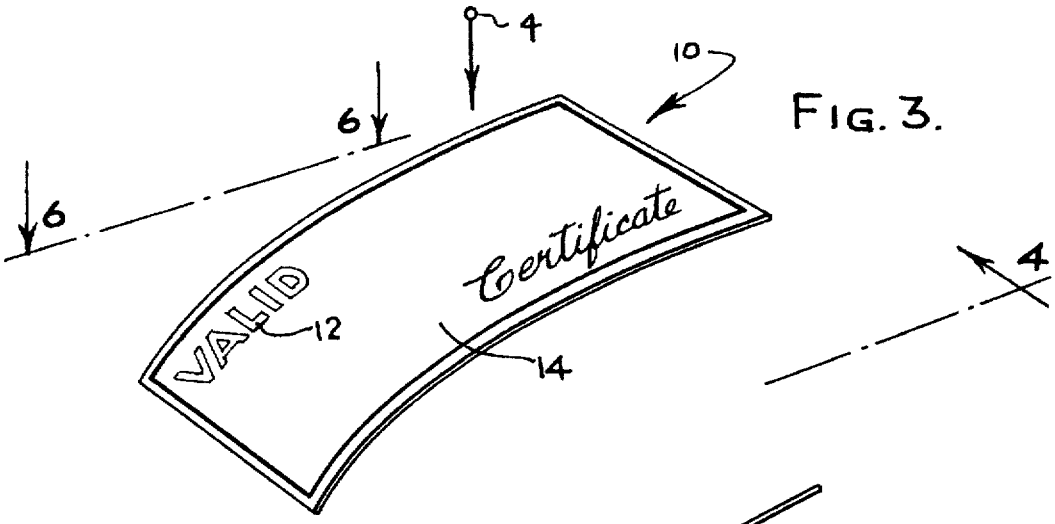
FIG. 3.
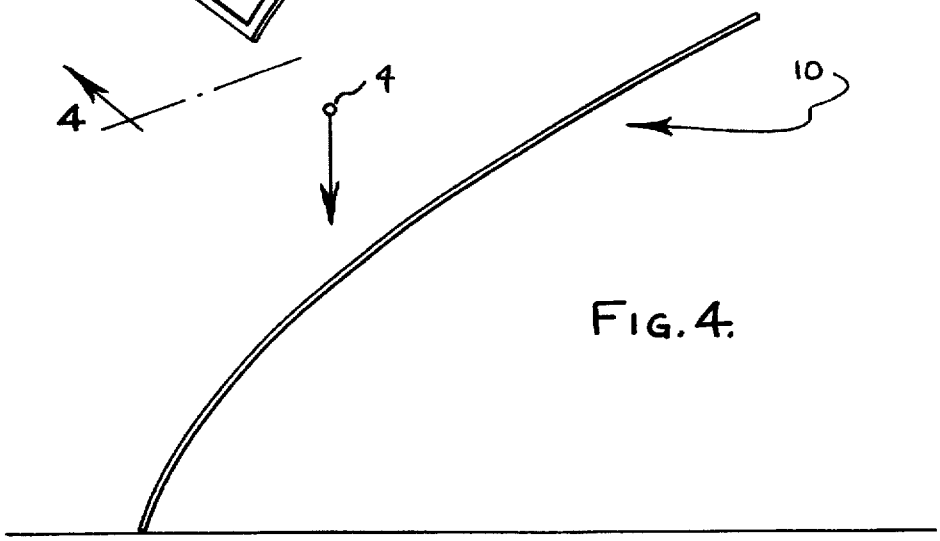
FIG. 4.

EMBOSSED DOCUMENT PROTECTION METHODS AND PRODUCTS

FIELD OF THE INVENTION

This invention relates generally to document protection methods and products.

BACKGROUND OF THE INVENTION

Many methods and products have been developed to deter counterfeiting of valuable documents or financial instruments such as currency. Most such documents are prepared by printing or lithography on high quality media such as silk, rice paper, and high contact rag paper, and the printing of original documents may be done either in black-and-white or in color, and if in color, either in spot color, colored backgrounds and/or multicolor printing. The common printing processes of valuable originals, whether in black and white or in color, are intaglio and gravure, among others. These and the other processes mentioned in this application are very well known in the art and will not be discussed in great detail.

Most of the useful examples in the prior art to deter counterfeiting and the like are intended to provide that copies are produced either with a clear moire pattern or with a "latent image" indicia that on the original document is invisible or nearly invisible to the naked eye.

An example of the means to print security documents is illustrated in U.S. Pat. No. 5,487,567 by Volpe. Volpe discloses a security paper having a desired "latent image" indicia formed by continuous lines at one angle and a background image also formed of continuous lines but at a different angle from the indicia. The indicia only becomes visible when copied.

It has become imperative for purposes of document security and safety that further improvements in the area of document protection be found. In the past, to ensure a document was authentic with a latent image required the document be photocopied or the like to see the latent image. To avoid this photocopying requirement to authenticate a document, there is a need for an easier means to ensure authenticity of documents with a latent image.

SUMMARY OF THE INVENTION

My invention provides a solution for an easier means to ensure a document authenticity with a latent image. My invention is a method and product for making a counterfeit resistant security document. The document has a first set of printed lines which form a latent image and a second set of printed lines at an angle relative to the first set which form a background image. The paper on at least one set of lines is embossed so as to render an image of the latent image visible only when viewed from pre-determined non-perpendicular angles relative to the document.

My invention follows the basic plate making and printing techniques used by the prior art to obtain documents with latent and background images. The invention differs from the prior an in that one set of lines for either the latent or background image is embossed to render the latent image visible only when viewed from pre-determined angles on the original document and not visible on a copied document.

It is therefore an object of the invention to provide a significantly improved method for verifying original documents.

It is an object of the invention to produce a document paper on which valuable documents can be printed, which allows for easy identification of authentic document paper.

These and other objects and advantages of the present invention can be determined from the following description of preferred embodiments according to the invention and the accompanying drawings and claims.

BRIEF DESCRIPTION OF THE DRAWINGS

FIG. 1 is an example of the present invention when the latent image is "invisible";

FIG. 2 is a side view of FIG. 1;

FIG. 3 is a view of the document shown in FIG. 1 at a predetermined angle rendering the latent image "visible";

FIG. 4 is a side view of FIG. 3;

solid line=printed line;

dotted lines=embossed and printed line; and dot-dash line=embossed line.

DETAILED DESCRIPTION OF THE PREFERRED EMBODIMENTS

Figure 7:
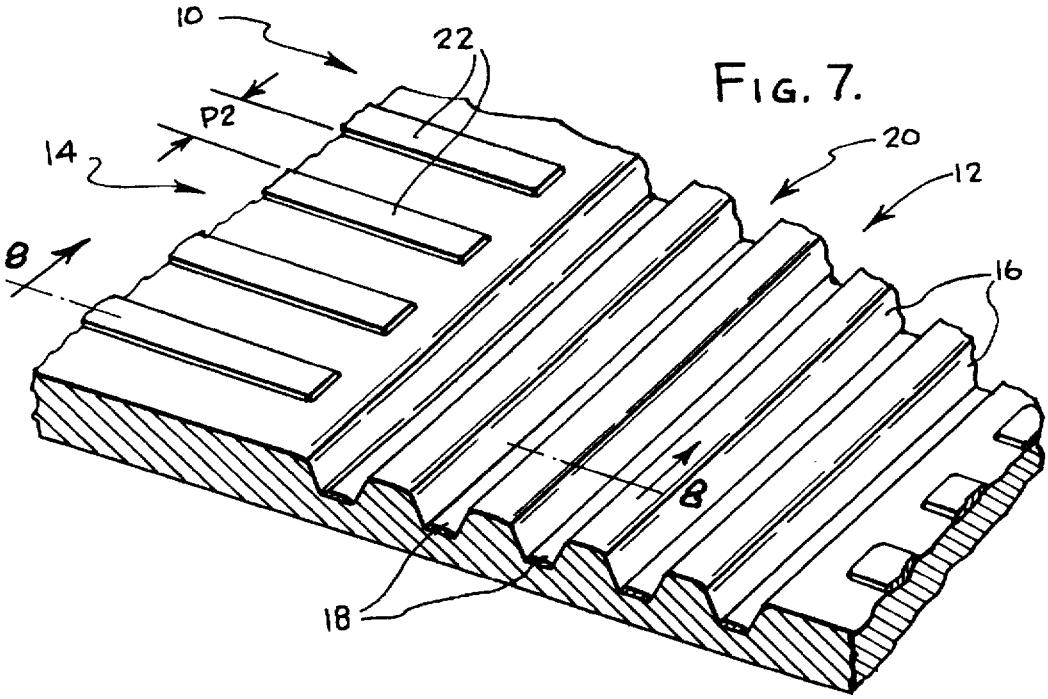
FIG. 7 is an enlarged fragmentary perspective view of FIG. 5 across line 7—7.

In this specification, I use the words "print" and "printing" to refer to the making of an original counterfeit resistant security document 10 regardless of the techniques used and the words "copy" and "copying" to refer to the making of copies from an original whether by copier or scanner technology. In the present invention, the security document 10 has three essential elements as shown in FIG. 7: an angled latent image 12, a background image 14, and embossed lines 16.

The term "latent image" is used here to indicate indicia that are printed on originals so as to be nearly invisible to the naked eye.

The term "angled latent image" 12 is a "latent image" when viewed (2) generally perpendicular and most non-perpendicular angles to the plane of the document 10 as shown in FIGS. 1 and 2, but which is readily visible when the document 10 is viewed (4) at pre-determined angles to the plane of the document as shown in FIGS. 3 and 4.

The term "embossed lines" 16 as used in this invention refers not to actual lines of print, but are grooved lines in the document 10 substrate in the design of a line formed when embossing occurs.

The term "line" as referred to in this specification means any type of line, such as circle, straight, wavy, broken, and dotted.

Figure 5:
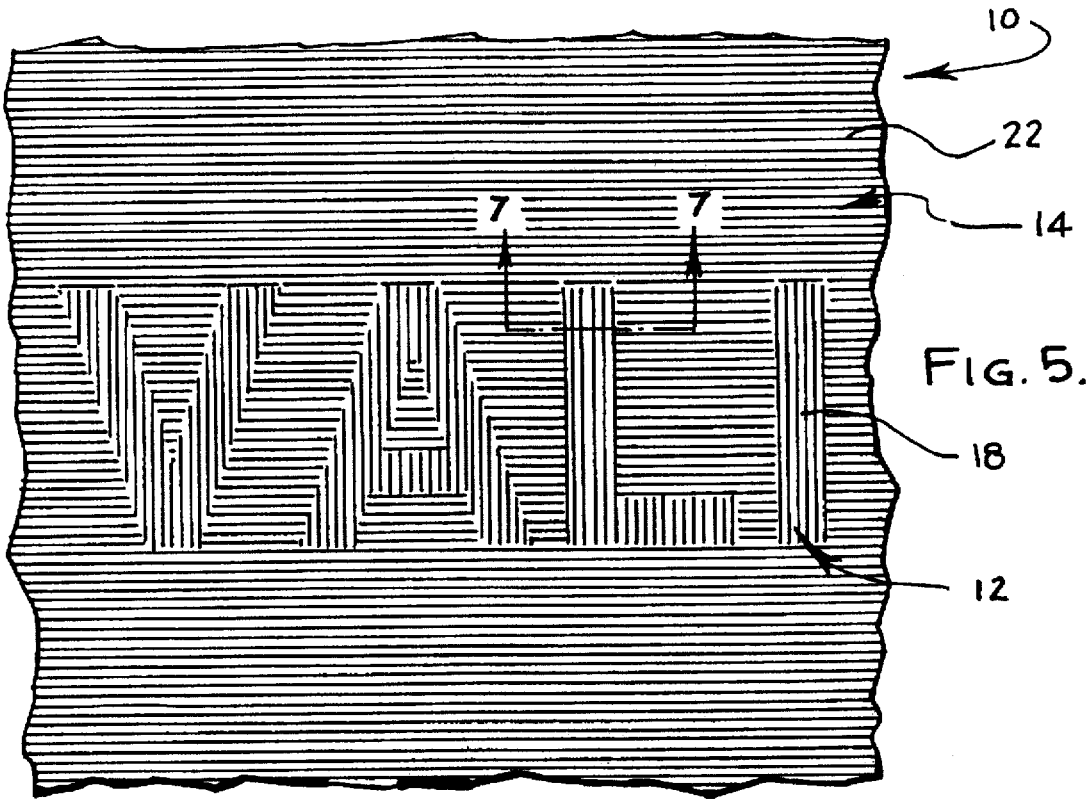
FIG. 5 is a cross-sectional view of FIG. 1 across line 5—5.

According to an embodiment of my invention, as shown in FIG. 5, I have provided an original document 10 printed on a substrate a first set of lines 18 that forms a latent image and a second set of lines 22 which form the background image 14. These two sets of lines 18, 22 are at relative angles to each other. Moreover, in this particular embodiment as shown in FIG. 7, the substrate of the document 10 is embossed with embossed lines 16 upon the first set of lines 18 to render the latent image an angled latent image 12.

Figure 8:
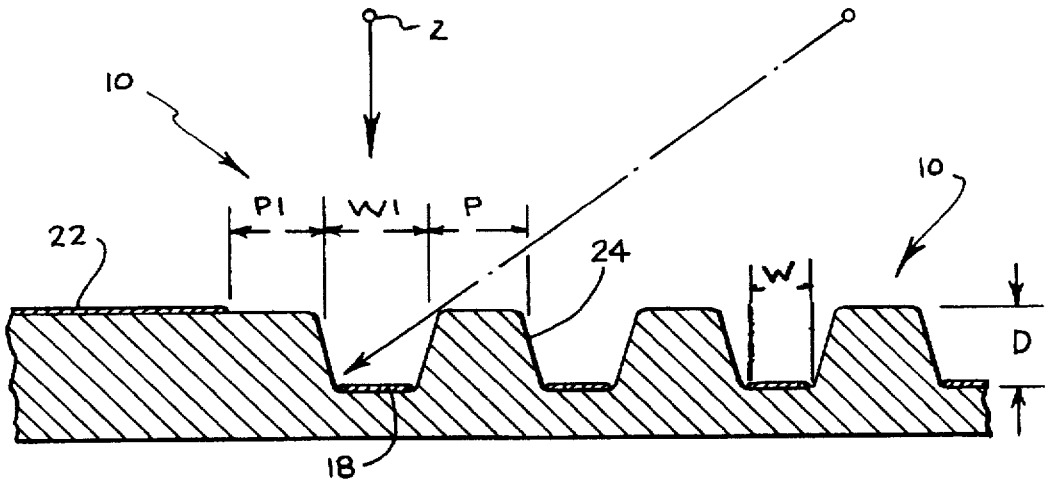
FIGS. 8 is an enlarged cross-sectional view of FIG. 7 across line 8—8.

The first set of lines 18 form the latent image "VALID" in FIGS. 1 and 3 although any letter, word or graphic indicia will work. The lines 18 can have a width (W as shown in FIG. 8) of between about 0.0005 and about 0.015 inches, but preferably they are of uniform width between about 0.0015 and about 0.008 inches. The overall pitch or line spacing (P) of lines 18 may be between 50 to 200 lines per inch, although the preferred range is from about 75 to about 140 lines per inch and an ideal of from about 90 to about 133 lines per inch. I have also found that according to my invention the printing of the lines 18 of the angled latent image 12 can but need not be repeated in more than four orthogonal angles of say 5°,45°,95° and 135° relative to the vertical document axis each to enhance document protection during copying, regardless of the scanning frequency of the copying equipment or the position of the original on the copier platen.

According to my invention, the presentation of the first set of lines 18 for the latent image of the indicia 20 is combined with the second set of lines 22 for the background image 14 between the indicia 20 that are specially made in accordance with this invention. As illustrated in FIG. 5, the second set of lines 22 are shown at an angle of preferably between about 10° and about 170° relative to the first set of lines 18 and more specifically from about 30° to about 120° relative to the first set of lines 18.

When seen by the naked eye, the first set of lines 18 of the latent image indicia 20 and the second set of lines 22 of the background 14 will appear to present a continuous pattern. Thus, the spacing (P1) between the first set of lines 18 and the second set of lines 22 is limited to a predetermined spacing dependent on the width of the lines. Preferably the second set of lines 22 are of the same width as the first set of lines 18 but they can vary in width relative to the first set of lines 18 up to a 1:6 ratio but most preferably between about a 1:1 ratio and about a 1:2 ratio. The pitch or line spacing (P2) between the second set of lines 22 may be different from the pitch of the first set of lines 18, as for example 133 lines per inch for the second set of lines 22 and 90 lines per inch for the first set of lines 18, but they also can be generally selected from within the same overall optical range of line pitch as the first set of lines, i.e., 50 to 200 lines per inch. The only requirements for the pitch spacing (P, P1 and P2) is that when the original document 10 is viewed (2) perpendicular the angled latent image 12 is "invisible" and when the document 10 is copied the angled latent image 12 is "invisible" at all angles. The second set of lines 22 preferably also use a variety of printing angles (up to four) in the document original, for example 5°,45°,90° and 135°.

In this embodiment of the invention as shown in FIG. 7, to render the latent image an angled latent image requires the first set of the lines 18 be embossed 16. In this illustration, the embossment occurs only upon the latent image indicia 20. Embossing as used in this embodiment of the present invention compresses in relief the substrate of the security document 10 to form embossed lines 16 on the first set of printed lines 18 to fall within the shadows of the relief as illustrated in FIG. 8. The embossing 16 may be felt on the reverse side of the original document as an alternative verification means of the originality of a document 10. This alternative verification means is sometimes not desired, thus the embossing on the reverse side of the document 10 can be suppressed by placing a plate on the reverse side of the document 10 when the document 10 is embossed.

Figure 6:
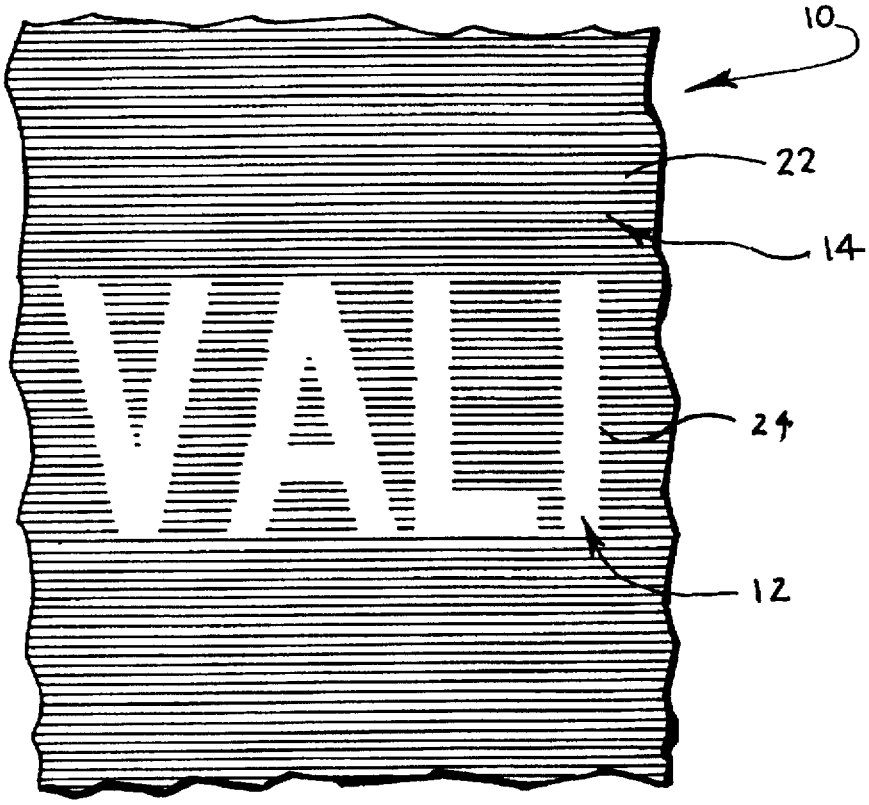
FIGS. 6 is a cross-sectional view of FIG. 3 across line 6—6.

As shown in FIG. 8, the embossment 16 has a width (WI) ranging from the width of the embossed line to about 20% greater than the width (W) of the embossed line. Preferably, the bottom of the embossment should have a width equal to the width of the line being embossed. Moreover, the depth (D) of the embossment 14 is equal to or greater than the width (W) of the embossed line. Thus, when the subject invention is viewed (4) from a pre-determined angle a reverse "white" image 24 of the angled latent image 12 appears and the first set of lines 18, in this embodiment of the subject invention, are hidden. "White" refers to the color of the document 10 paper. A reverse "white" image 24 of the angled latent image 12 of the present invention is illustrated in FIG. 6.

The present invention as described above can be diagrammed as shown in FIG. 9. The dotted lines illustrate the angled latent image 12 as an embossed first set of lines 18, 16 and the straight lines illustrate the background image 14 as a second set of lines 22. When this embodiment of the present invention is utilized, the angled latent image 12 of document 10 as viewed (4) from the pre-determined angles is a reverse "white" image 24.

Figure 10:
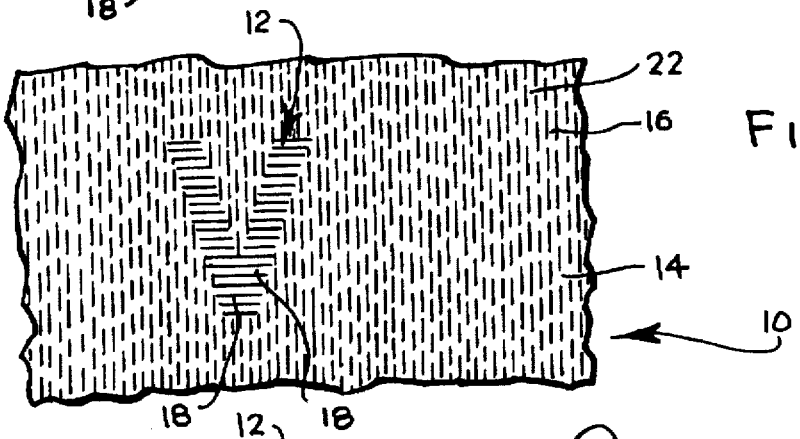
FIG. 10 illustrates a diagram of an alternative embodiment of the present invention.

In contrast to a reverse "white" image 24, the embodiment as illustrated in FIG. 10 will render the image of angled latent image 12 visible. In this embodiment, the background image 14 is an embossed set of second lines 22, 16 and the angled latent image 12 is a set of first set of lines 18. The background image 14 falls within the shadows of the embossed lines 16 when document 10 is viewed at pre-determined non-perpendicular angles. Thus, the image of the angled latent image 12 becomes visible and a reverse "white" image 24 of the background image appears when document 10 is viewed at pre-determined non-perpendicular angles.

Figure 9:
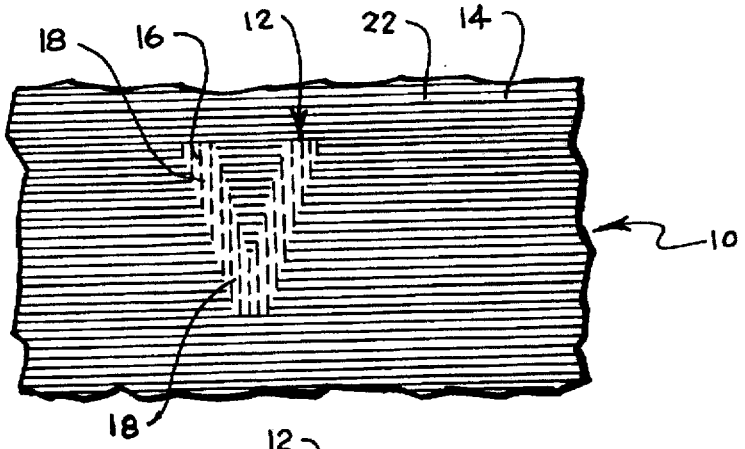
FIG. 9 illustrates a diagram of the present invention shown in FIG. 7.
Figure 11:
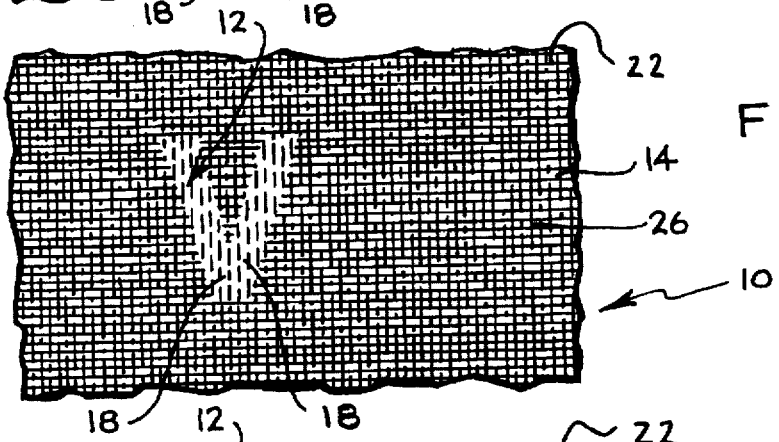
FIG. 11 illustrates a diagram of a second alternative embodiment of the present invention.
Figure 12:
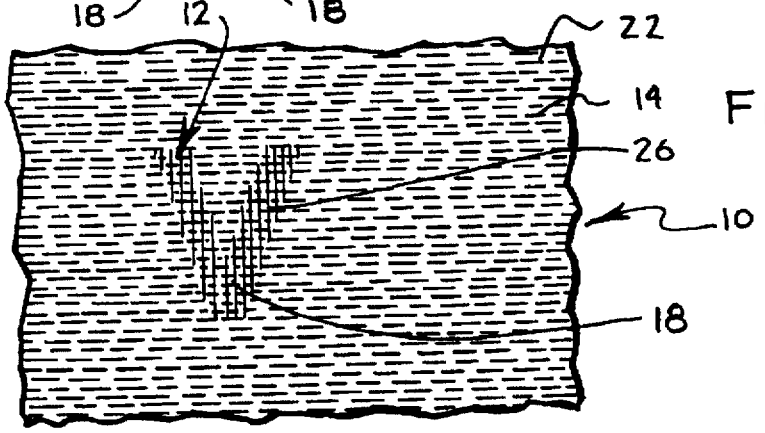
FIG. 12 illustrates a diagram of a third alternative embodiment of the present invention. Key to diagrams of FIGS. 9–12.

In other embodiments of the present invention, FIGS. 11 and 12 illustrate alternative embodiments of FIGS. 9 and 10 respectively. In FIG. 11, the background image 14 has embossed lines 26, represented by a dot-dash line, that are at an angle to the background image 14. In order to utilize this embodiment, the embossed lines 26 must follow the angle of the first set of lines 18 when applied to both the angled latent image 12 and the background image 14. The results are the same as in FIG. 9 in that when the document 10 is viewed from a pre-determined angle the angled latent image 12 is a reverse "white" image 24.

In contrast to FIG. 11, FIG. 12 illustrates that the angled latent image 12 has embossed lines 26 that follow the angle of the second set of lines 24 when applied to both the angled latent image 12 and the background image 14. The results are the same as in FIG. 10 in that when the document 10 is viewed from a pre-determined angle the background image 14 is a reverse "white" image 24.

The present invention, as illustrated in FIGS. 9 through 12, is sufficiently flexible to use other various alternative embodiments. The printed line can be any type of line so long as the line can be embossed. It is even possible to break up the patterns of both of the first set of lines 18 and the second set of lines 22 by random sized white areas, for example, to create an overall cloud-like pattern on the original document regular overlay pattern, like a diamond pattern. Such a cloud-like pattern is a well known technique to further disguise the protection system on the security document. Other overall designs work as well with my present invention in which the pitch and angles of lines remain the same, but the print density from the top of the document to the bottom is decreased from about 20% to about 5% by gradually changing the line thickness from about 0.002 inches to about 0.0005 inches to present a continuous dark to light background. As the word(s) or graphic in the latent image indicia is sufficiently large compared to the random areas or the repetition in the pattern, these occasional breaks in the first set of lines of the latent image indicia, or the variation in present density written the ranges disclosed, will not defeat the intent of the invention. To use these alternative embodiments requires that one of the set of printed lines must be embossed to render a latent image of the security document an angled latent image.

The latent images of the original document of my invention is printed by, for example, photographing a negative of a solid of the desired indicia, say the word "VALID", through a line screen of 90 lines per inch, each about 0.002 inches in width. A second negative is made from the composite image the background pattern as produced with the composite negative-positive film as described above in further combination with the solid indicia which then is printed with the original first set of lines indicia to form a pattern in positive to form the composite image by which the entire document can be printed from plates made from the film. Other indicia such as "VOID" that would be shown on copies would be acceptable and useful examples are shown in U.S. Ser. No. 08/666,006 (Wicker). Various ways in making these films and plates are well known in the art, including the use of color separations and/or split ink fountains to print in multicolors, and computer generated methods as well.

The illustrations show straight line patterns for the second set of lines 24, but curved line patterns may also be used provided the width and pitch of the lines and embossing follow my invention. Similarly, there can be many angled latent images 12 and latent images on a document 10. The multiple first set of lines 18 need not all be in the same two directions within the pattern on the document 10 but can be patterned at different angles even adjacent to each other to further the camouflage the indicia 20, varied up to the preferred four angles throughout the pattern background 14.

The images of the angled latent images 12 and the images of the background image 14 can be related to each other in a configuration or design which can drawn by hand, computer formed, or composed on film or printing plates, all as known to those skilled in the art, or, as is also known, after creation converted to an electronic program or disk to transfer images direct to plate or to print using the programmer disk on any laser or other conventional output device. Embossing the substrate of the original document 10 can be done by known methods such as relief plates, commonly used in engraving printing. Although not necessary, never the less pantographs or designs can be overprinted or reversed out of the pattern as for example the cloud pattern identified earlier. For optimum safety, the invention can also be used in combination with other methods, such as using a visible image to produce a moire pattern as disclosed, for example in U.S. Pat. Nos. 5,018,767 and 5,193,853, the latter of which discloses that the lines may be at a desired pitch deliberately selected so as to vary minutely from the pitch of the scanning trace of known copying machines and video options.

After the security document 10 has the latent images and the background images 14 printed, the security document is placed upon a conventional embossment machine wherein the lines that are to be embossed are matched with an embossing plate having the same angle as the lines that are to be embossed. The document is then embossed 16 within a conventional embossing machine. In an alternative embodiment of this process, the same printing machine can print and emboss simultaneously.

Although my invention is described by reference to specific preferred embodiments, it is clear that variations can be made or other material used without departing from the spirit of the invention as claimed.

What I claim is:

1. A counterfeit resistant security document comprising:

a support having a side comprising a print surface;

a first set of printed lines on the print surface having a predetermined first color, pitch, line width, and line height in a defined area and which form a a first image;

a second set of printed lines on the print surface forming a visible background image and having a predetermined second color, pitch line width and line height throughout the defined area and printed at an angle other than the angle of said first set of printed lines, the predetermined color, pitch and line width of each set of printed lines being such as to render said first image a latent image substantially indistinguishable from the background image to the naked eye and copiers when viewed or copied substantially at a right angle to the print surface;

a third set of lines that consist of a set of linear embossments that form grooves in said support at the print surface side and on which at least part of one of the sets of printed lines is registered and superimposed, the embossments having a predetermined pitch substantially identical to the pitch of the one set of printed lines, a predetermined width equal to or greater than the width and a depth greater than the height of the one set of printed lines, the said part of the one set of printed lines lying entirely within the grooves as to render the image of said latent image visible only when viewed from non-perpendicular angles relative to said document print surface and angle of embossment.

2. The document according to claim 1 in which the first and second sets of printed lines have a width from about 0.0005 inches to about 0.015 inches and said pitch is between 50 to 200 lines per inch.

3. The document according to claim 1 in which the width of each embossment of the third set of lines is equal to, to about 20% greater than the width of the one set of printed lines.

4. The document according to claim 1 in which the depth of each embossment of the third set of lines is equal to or greater than the width of the one set of printed lines.

5. A method of making a counterfeit resistant document comprising the steps of:

printing a first set of printed lines to form a first image and having a predetermined first color, pitch, line width, and line height in a defined area on a support having a side comprising a print surface;

printing a second set of printed lines on said print surface to form a visible background image and having a predetermined second color, pitch, line width and line height throughout the defined area and printed at an angle other than the angle of said first set of printed lines, the predetermined color, pitch, and line width of each set of printed lines being such as to render the first image a latent image that is substantially indistinguishable from the background image to the naked eye and copiers when viewed or copied substantially at a right angle to the print surface;

printing a third set of lines that consist of a set of linear embossments that form grooves in the support at the print surface side and on which at least part of one of the sets of printed lines is registered and superimposed, the embossments having a predetermined pitch substantially identical to the pitch of the one set of printed lines, a predetermined width equal to or greater than the width and a depth greater than the height of the one set of printed lines, the said part of one set of printed lines lying entirely within the grooves as to render said latent image visible only when viewed from non-perpendicular angles relative to said document print surface and angle of embossment.

6. A method of making a counterfeit resistant document according to claim 5 wherein the embossing occurs on said first set of lines.

7. A method of making a counterfeit resistant document according to claim 5 wherein the embossing occurs on said second set of lines.

8. The document according to claim 2 in which the first and second sets of printed lines have a width from about 0.0015 inches to about 0.008 inches and said pitch is between 75 and 140 lines per inch.

9. The document according to claim 1 in which the one set of printed lines is the first set of printed lines so as to render the reverse image of said latent image visible only when viewed from a pre-determined non-perpendicular angle relative to said document print surface and angle of embossment and which the second set of lines are printed at a predetermined angle relative to said first set of printed lines.

10. The document according to claim 1 in which the one set of printed lines is the second set of printed lines so as to render the image of said latent image visible only when viewed from a pre-determined non-perpendicular angle relative to said document print surface and angle of embossment.

11. A counterfeit resistant security document comprising:

a support having a side comprising a print surface;

a first set of printed lines on the print surface having a predetermined first color, pitch, line width and line height in a defined area on said support;

a second set of lines that consist of a set of linear embossments that form grooves in said support at the print surface side and on at least a part of said first set of printed lines to form a latent image from one of said set of lines, the embossments substantially in registered with the first set of printed lines and having a predetermined pitch substantially identical to the pitch of the first set of printed lines, a predetermined width equal to or greater than the width and a depth greater than the height of the first set of printed lines, the part of the first set of printed lines lying entirely within the grooves as to render said latent image visible only when viewed from non-perpendicular angles relative to said document and angle of embossment.

12. The document according to claim 11 in which the first set of printed lines has a width from about 0.0005 inches to about 0.015 inches and said pitch is between 50 to 200 lines per inch.

13. The document according to claim 12 in which the first set of printed lines has a width from about 0.0015 inches to about 0.008 inches and said pitch is between 75 and 140 lines per inch.

14. The document according to claim 12 in which the width of each embossment of the second set of lines is equal to, to about 20% greater than the width of the line of the part of the first set of printed lines on which the embossment line is superimposed.

15. The document according to claim 11 in which the depth of each embossment of the second set of lines is at least equal to or greater than the width of the line of the part of the first set of printed lines on which the embossment line is superimposed.

16. A method of making a counterfeit resistant document comprising the steps of:

printing at least a first set of printed lines having a predetermined pitch and line width and line height in a defined area on a support having a side comprising a print surface;

printing a second set of lines that consist of a set of linear embossments that form grooves in said support at the print surface side and on which at least a part of said first set of printed lines is registered and superimposed to form a latent image, the embossment having a predetermined pitch substantially identical to the pitch of the part of the first set of printed lines, a predetermined width equal to or greater then the width and a depth greater than the height of the part of the first set of printed lines the part of the first set of printed lines lying entirely within the grooves as to render said latent image visible only when viewed from non-perpendicular angles relative to said document print surface and angle of embossment.

17. A method according to claim 16 wherein the printing of said first set of printed lines and said second set of lines occurs simultaneously.

18. A method according to claim 16 wherein the printing of said first set of printed lines occurs first and said second set of lines later.

* * * * *